US005820121A

United States Patent [19]

Lan

[11] Patent Number: 5,820,121

[45] Date of Patent: Oct. 13, 1998

[54] COAXIAL SHEETS SEPARATING AND DELIVERING DEVICE

[76] Inventor: Chia-Tsui Lan, No. 6-2, Chien-Kuo-Hsin-Tsun, 9th Lin, San-Te Tsun, Kuei-Shan Hsiang, Tao-Yuan Hsien, Taiwan

[21] Appl. No.: 739,599

[22] Filed: Oct. 30, 1996

[51] Int. Cl.[6] ..... B65H 3/46

[52] U.S. Cl. ..... 271/121; 271/124; 271/125; 271/167

[58] Field of Search ..... 271/121, 124, 271/125, 167

[56] References Cited

U.S. PATENT DOCUMENTS

| | | | |
|---|---|---|---|
| 4,667,244 | 5/1987 | Ishikawa | 271/121 |
| 5,549,289 | 8/1996 | Sonnenburg et al. | 271/121 |
| 5,570,876 | 11/1996 | Samii | 271/121 |

FOREIGN PATENT DOCUMENTS

| | | | |
|---|---|---|---|
| 002664247 | 1/1992 | France | 271/121 |
| 3-26618 | 2/1991 | Japan | 271/121 |
| 3-88645 | 4/1991 | Japan | 271/121 |
| 3-147650 | 6/1991 | Japan | 271/121 |

*Primary Examiner*—H. Grant Skaggs
*Assistant Examiner*—Patrick Mackey
*Attorney, Agent, or Firm*—Beveridge, DeGrandi, Weilacher & Young LLP

[57] ABSTRACT

A coaxial separating and delivering device generally comprises a main shaft having a plurality of synthetic delivering rollers. A positioning pin is disposed vertically on the main shaft. A rotational separating roller is disposed at the middle portion of the shaft such that the outer diameter of the separating roller is smaller than the delivering roller. The separating roller is configured by a tube having a friction wheel disposed thereof. One end of the tube is provided with a curve cutout which receives a positioning pin disposed at the main shaft. The separating roller is rotational within a certain angular sectors, accordingly, the paper sheet can be separated simultaneously with delivering. Since the separating roller and delivering roller are disposed coaxially, a compact design is attained.

10 Claims, 4 Drawing Sheets

COAXIAL SHEETS SEPARATING AND DELIVERING DEVICE

FIELD OF THE INVENTION

The present invention relates to a sheets separating and delivering device, more particularly, to a coaxial sheets separating and delivering device wherein the separating roller and the delivering roller are disposed at the same shaft to reduce the elements used, accordingly, the bulk size is reduced as well.

DESCRIPTION OF PRIOR ART

In the official facilities for paper works, such as the fax machine and scanner, in order to increase the operating speed, both for transmitting and scanning, those facilities are equipped with functions of automatic sheets separating and delivering device. In the existing sheets separating mechanism, a separating roller is disposed on a shaft and a friction plate is pressed against the separating roller. An electric clutch is disposed at one end of the shaft and a sensor is disposed at the traveling path of the paper. The paper sheets are loaded between the friction plate and the separating roller and the separating roller is pressed against the first paper. When the delivery is started, the shaft is rotated by the driving mechanism and the separating roller is rotated accordingly. Consequently, the paper sheet is drawn in by the rotated roller. On the other hand, a pair delivering rollers are disposed along the traveling path of the paper after the sensor. By this arrangement, the paper sheet can be delivered. When the paper sheet passes over the sensor, the paper sheet is detected and a signal is sent to stop the driving mechanism. The electric clutch is triggered and the shaft is stopped rotating. As a result, the paper sheet is stopped loading. When a new paper sheet needs to be transmitted or scanned, the driving mechanism can be re-started again and the electric clutch is neutralized to re-load the paper sheet. By this arrangement, in the continuous loading mode, the succeeding paper sheet shall be spaced apart with the forgoing paper to let the fax or scanner have enough time in scanning.

Since the separating roller and the delivering roller are disposed in individual shaft respectively, especially for the sheets separating, the shaft is controlled by an electric clutch. Consequently, the bulk size of the device is comparably large. Nevertheless, all the facilities are aimed to a compact design, i.e. more lighter, more thinner, more shorter and more smaller. But when two individual shafts are applied, not only will it increase the manufacturing cost, but also will increase the bulk size. The market competitive capability is reduced.

As shown in FIGS. 5 and 6, one end of the shaft (b) of the separating roller (a) is disposed with an one-way clutch (c.). A pair of delivering rollers (d) is disposed downstream of the separating roller (a) and the delivering rollers (d) are disposed on an individual shaft. The front portion of the clutch (c.) is provided with a tube (c1) having a boss (c11) therein. The peripheral of the shaft (b) is provided with a surface (b1) and the tube (c1) is capable of enveloping onto the surface (b1) of the shaft (b) such that an offset angle $\phi$ is established between the tube (c1) and the surface (b1) of the shaft (b). Besides, the one-way clutch is connected to the driving mechanism. The outer diameter of the separating roller (a) is smaller than that of the delivering roller (b). By this arrangement, when the shaft (b) is rotated by the one-way clutch (c.), the boss (c11) of the tube (c1) of the clutch (c.) will press against the surface (b1) of the shaft (b), consequently, the shaft (b) is rotated to drawing the paper sheet by the separating roller (a) and the paper sheet is sent out by the delivering rollers (d). Since the outer diameter of the separating roller (a) is smaller than that of delivering roller (d), the delivering roller (d) is contacting with the paper sheet, the speed of the separating roller (a) is higher than the shaft (b), as a result, the boss (c11) in the tube (c1) of the clutch (c.) is moved away from the surface (b1) of the shaft (b). When the end portion of the paper sheet is released from the separating roller (a), since the boss (c11) of the tube (c1) is moved away from the surface (b1) of the shaft (b), the separating roller (a) is stopped rotating until the boss (c11) of the tube (c1) is engaged with the surface (b1) of the shaft (b) again. Then the paper sheet is therefore drawn in by the separating roller (a). During the disengagement between the boss (c11) and the surface (b1), the succeeding paper is spaced apart from the forgoing paper.

Even when the paper is separated by a separating roller (a) with an offset angle, it still has two individual shafts, separating shaft (a) and delivering shaft (d). The bulk size of the device still can not be reduced still.

SUMMARY OF THE INVENTION

It is the object of this invention to provide a coaxial separating and delivering device for fax machine or scanner wherein the separating roller and the delivering roller are disposed at the same shaft to reduce the elements used, for example, two individual shafts are replaced by a single shaft. Accordingly, the drawback of the conventional separating and delivering device can be completely solved.

It is another object of the present invention wherein the elements used are reduced, accordingly the bulk size of the separating and delivering device is reduced. A compact design is therefore attained.

It is still the object of this invention wherein the separating roller and the delivering roller are disposed at the same shaft, accordingly, the element is reduced and the bulk size is reduced also, a lighter, thinner, shorter and smaller design is attained.

In order to achieve the object set forth, the coaxial separating and delivering device made according to this invention generally comprises a main shaft having a plurality of synthetic delivering rollers. A rotational separating roller is disposed at the middle portion of the shaft such that the outer diameter of the separating roller is smaller than the delivering roller. The separating roller is configured by a tube having a friction wheel disposed thereof. One end of the tube is provided with a curve cutout which receives a positioning pin disposed at the main shaft. By this arrangement, the separating roller is rotational within certain angular sectors, accordingly, the paper sheet can be separated simultaneously with delivering. Since the separating roller and delivering roller are disposed coaxially, a compact design is attained.

BRIEF DESCRIPTION OF THE DRAWINGS

In order that the present invention may more readily be understood the following description is given, merely by way of example with reference to the accompanying drawings, in which.

DETAILED DESCRIPTION OF PREFERRED EMBODIMENT

Figure 1:
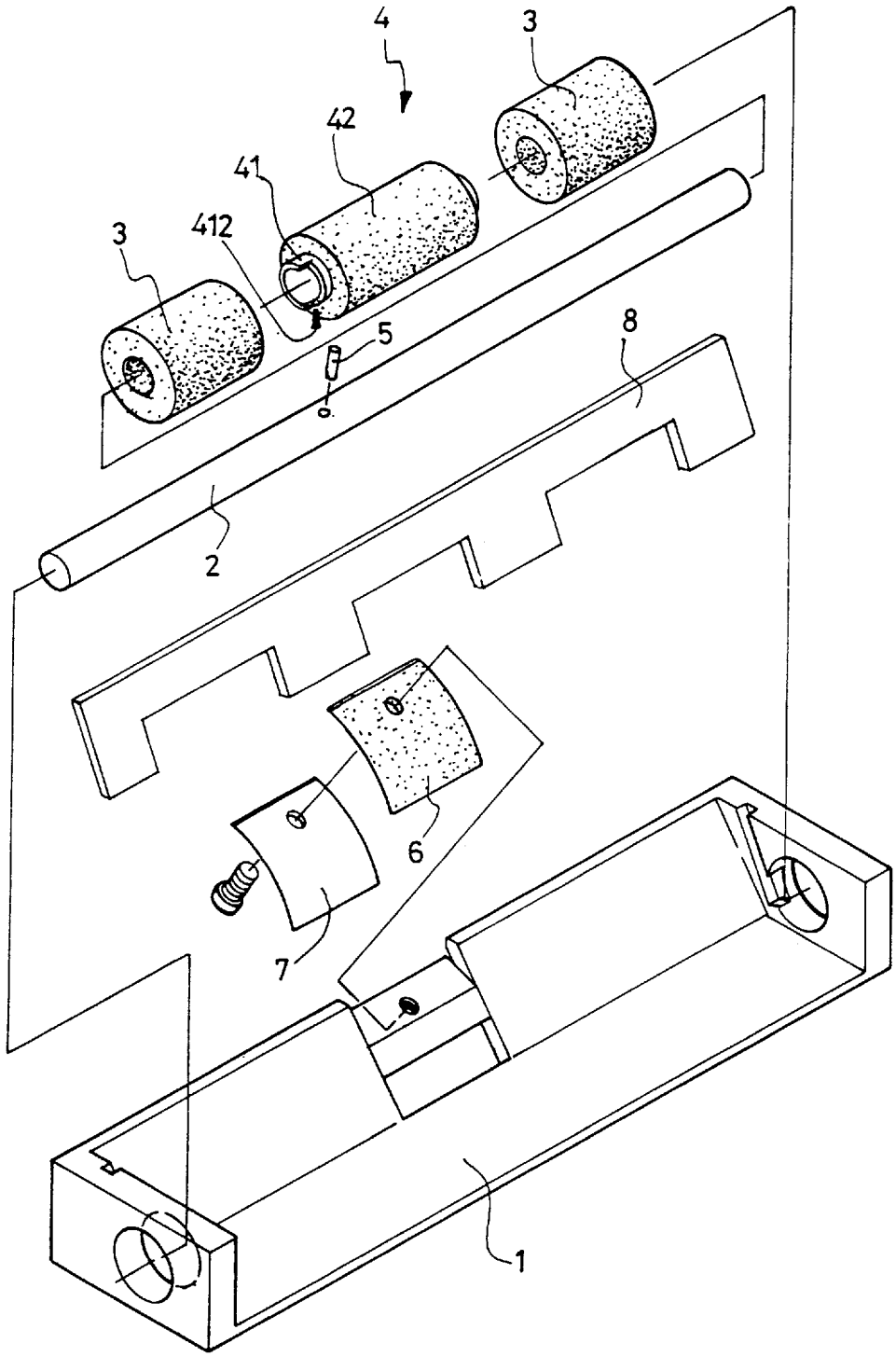
FIG. 1 is a perspective view of the separating and delivering device made according to this invention.
Figure 2:
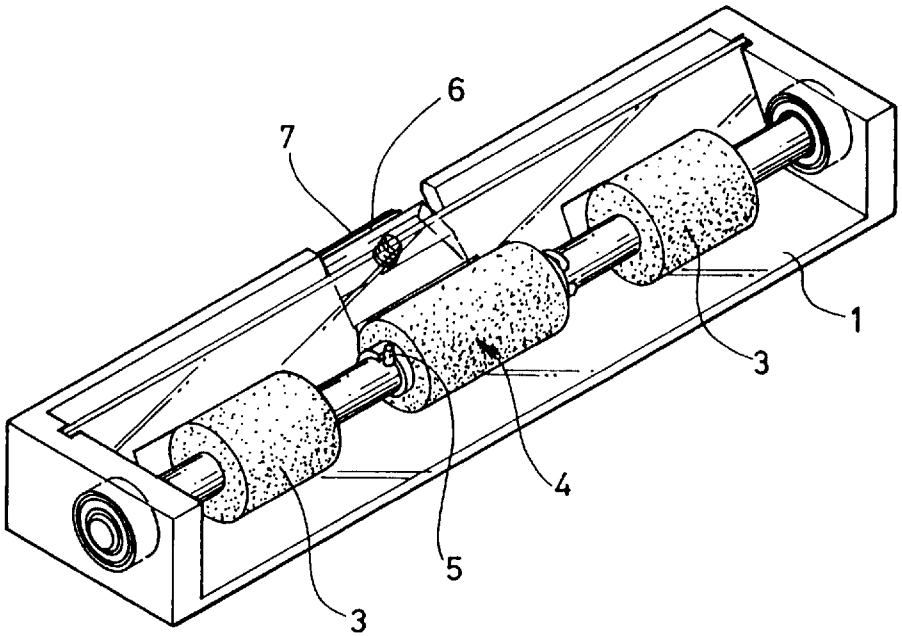
FIG. 2 is a perspective view of this invention.

Referring to FIGS. 1 and 2, the separating and delivering device made according to this invention generally comprises a housing 1 having a main shaft 2 installed horizontally thereof. The main shaft 2 is disposed with a plurality of delivering rollers 3 symmetrically. The main shaft 2 is further provided with a separating roller 4 having a small outer diameter that the delivering roller 3. The separating roller 4 is configured with a tube 41 having a friction wheel 42 disposed thereof. One end of the tube 41 is provided with a curve cutout 412. A positioning pin 5 is disposed vertically on the shaft 2. The positioning pin 412 is received within the curve cutout 412. By this arrangement, the separating roller 4 is rotational within certain angular sectors.

The housing 1 is further disposed with a damping element 6 at rear side. The damping element 6 can be a rubber plate and a spring plate 7 is provided to bias the damping element 6. By this arrangement, the damping element 6 is pressed against the peripheral of the separating roller 4. A guiding bracket 8 is disposed in front of the damping element 6.

Figure 3:
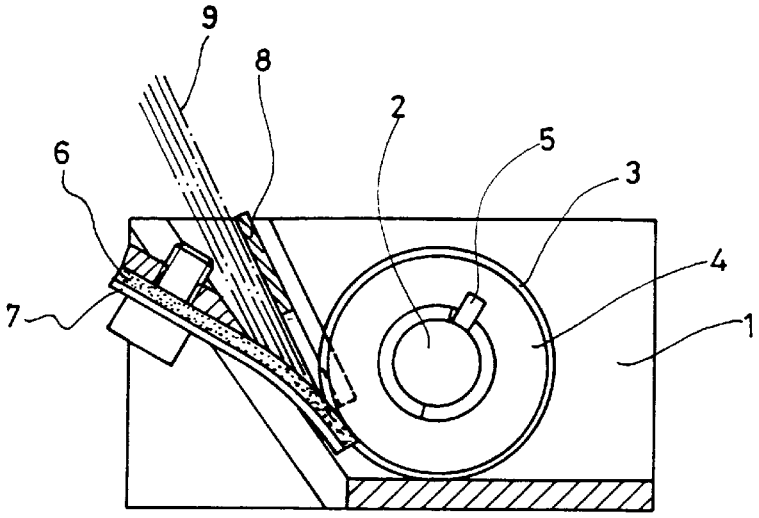
FIG. 3 is a cross section view of this invention.
Figure 4:
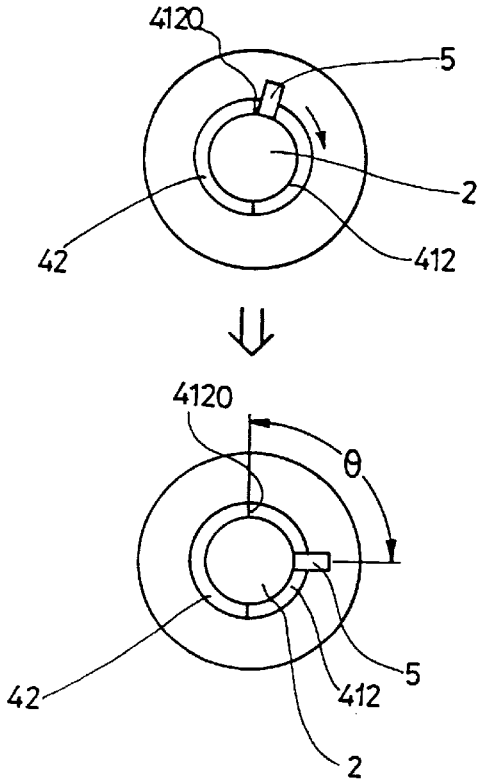
FIG. 4 is a schematic illustration showing the operation of this invention.
Figure 5:
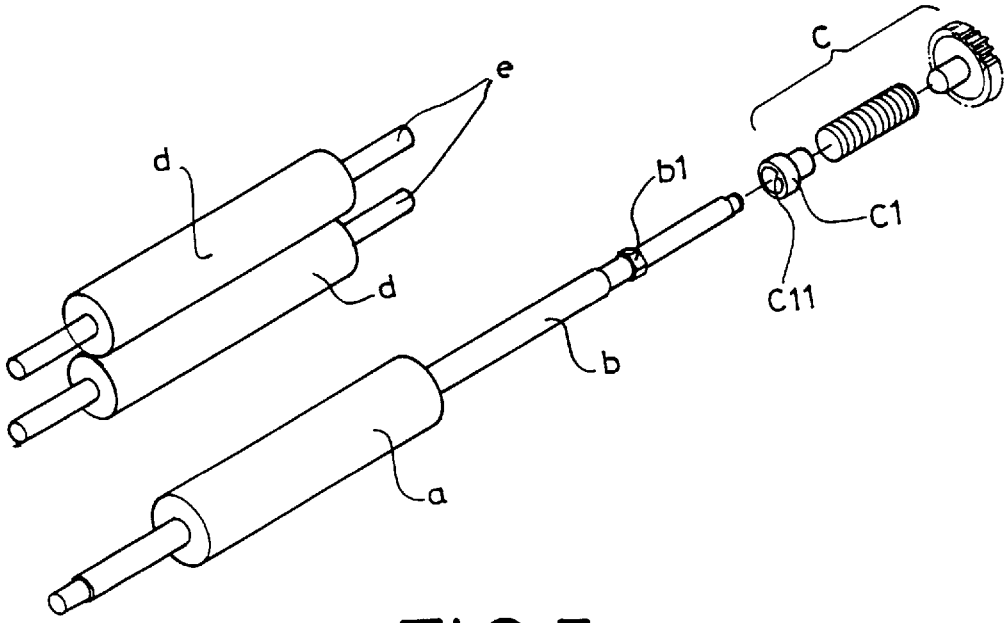
FIG. 5 is a perspective view of a conventional separating and delivering device.
Figure 6:
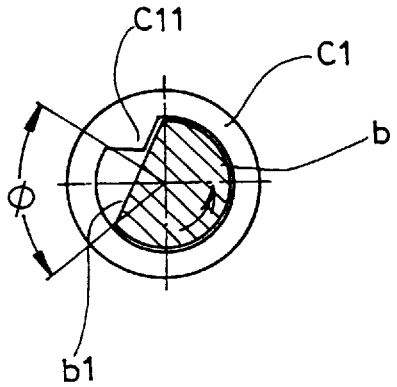
FIG. 6 is a cross sectional view of the separating and delivering device incorporated with an one-way clutch thereof.

As shown in FIGS. 3 and 4, the paper sheets 9 are loaded between the guiding bracket 8 and damping element 6 such that the separating roller 4 is pressed on the first sheet of the papers 9 while the rest papers are stopped by the damping element 6. At this stage, the positioning pin 5 is pressed against the edge 4120 of the curve cutout 412 of the separating roller 4. Accordingly, when the main shaft 2 is rotated, the separating roller 4 is driven to rotate and draw in the paper. Since the delivering roller 3 is engaged with the main shaft 2, when the paper sheet 9 is drawn in, the paper 9 is also pressed by the delivering roller 3 to deliver the paper. Because the outer diameter of the delivering roller 3 is larger than that of the separating roller 4, the tangential speed V3 of the delivering roller 3 is faster than the tangential speed V4 of the separating roller 4. On the other hand, the separating roller 4 is rotational on the main shaft 2, when the delivering roller 3 is in contacting with a loaded paper 9, the tangential speed V4 of the separating roller 4 is increased and equal to the tangential speed V3 of the delivering roller 3. When the tangential speed V4 equals to tangential speed V3, the rotating speed of the separating roller 4 is higher than that of the main shaft 2, consequently, the positioning pin 5 on the main shaft 2 is moving away from the edge 4120 of the curve cutout 412 of the tube 41. In this stage, the paper sheet 9 is delivered by the delivering roller 3 and when the paper sheet 9 is moved away, an offset angle θ is established between the positioning pin 5 and the edge 4120 of the curve cutout 412, as clearly shown in FIG. 4. Since the positioning pin 5 is moved away from the edge 4120 of the curve cutout 412, the separating roller 4 will not be driven by the main shaft 2. The separating roller 4 will resume to rotate when the positioning pin 5 on the main shaft 2 is pressed against the edge 4120 of the curve cutout 412 again. In the same time, the paper sheet 9 can be drawn in by the separating roller 4 repeatedly.

Furthermore, the distance between a succeeding paper and a forgoing paper can be decided by the angle θ between the positioning pin 5 and the edge 4120 of the curve cutout 412. Accordingly, the distance $S=r\theta$ wherein r is the radius of the separating roller 4. Besides, the θ can be calculated from the difference between the radius of the delivering roller 3 and the separating roller 4. The larger the difference, the larger the angle θ, to the reverse, the small the difference, the smaller the angle θ.

Since the separating roller 4 and the delivering roller 3 are disposed coaxially on the main shaft 2, the number of shaft is reduced. The bulk size of the driving mechanism is therefore reduced to meet the requirements for compact design. The manufacturing cost is also reduced.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A combination separating and delivery mechanism for a paper separating and delivery apparatus, comprising:

a rotatable main shaft;

at least one delivery roller coaxially fixed about said main shaft such that said delivery roller rotates with said main shaft when said main shaft is rotated;

a separating roller rotatably engaged about said main shaft such that said separating roller is independently rotatable about said main shaft; and selective coupling means for selectively coupling said separating roller with said main shaft such that said main shaft drives said separating roller to rotate with said main shaft when said main shaft is rotated.

2. The mechanism defined in claim 1, wherein:

a diameter of said delivery roller is larger than a diameter of said separating roller and, when said separating roller is coupled by said selective coupling means with said main shaft, said separating roller has a peripheral speed slower than a peripheral speed of said delivery roller.

3. The mechanism defined in claim 2 wherein:

when said delivery roller and said separating roller simultaneously engage a sheet of paper to be delivered, said separating roller is decoupled from said main shaft and said peripheral speed is increased to approximately equal said peripheral speed of said delivery roller.

4. The mechanism defined in claim 3, wherein:

said separating roller includes an outer portion fixed about an inner tube, said inner tube being coaxially and rotatably engaged with said main shaft, and said selective coupling means includes a pin and opening combination, said opening being defined by said inner tube and said pin extending from said main shaft and cooperatively engaging said opening, said opening being larger than said pin such that said pin is movably positionable therein.

5. The mechanism defined in claim 4, wherein:

said opening is defined such that said pin engages an end piece of said opening to couple said separating roller to said main shaft when said main shaft rotates faster than said separating roller.

6. The mechanism defined in claim 5, wherein:

said opening is defined such that said end piece of said opening is disengaged from said pin to decouple said main shaft from driving said separating roller when said separating roller is rotated faster than said main shaft.

7. A paper feeding apparatus, comprising:

a housing member;

a main shaft rotatably supported by said housing member;

rotating means for rotating said main shaft relative to said housing member;

at least one delivery roller coaxially fixed about said main shaft such that said delivery roller rotates with said main shaft when said main shaft is rotated;

a separating roller rotatably engaged about said main shaft such that said separating roller is independently rotatable about said main shaft, a diameter of said separating roller being less than a diameter of said delivery roller such that when said separating roller and said delivery roller have equal peripheral speeds, said separating roller rotates faster than said delivery roller;

selective coupling means for selectively coupling said separating roller with said main shaft such that said main shaft drives said separating roller to rotate with said main shaft when said main shaft is rotated by said rotating means;

a guiding bracket having a separating roller access opening and at least one delivery roller access opening, said guiding bracket being supported by said housing member and positioned such that said separating roller access opening is aligned with said separating roller and said delivery roller access opening is aligned with said delivery roller;

a damping element positioned opposite said separating roller, said separating roller access opening of said guiding plate being interposed therebetween; and a spring plate supported by said housing member and biasing said damping element toward said separating roller;

wherein said guiding bracket and said damping element define a paper feed slot, and said separating roller is partly disposed through said separating roller access opening in said paper feed slot and contacts said damping element.

8. The paper feeding apparatus defined by claim 7, wherein:

said separating roller includes an outer portion engaged about an inner tube, said inner tube being coaxially and rotatably engaged with said main shaft, and said selective coupling means includes a pin and opening combination, said opening being defined by said inner tube and said pin extends from said main shaft and cooperatively engages said opening, said opening being larger than said pin such that said pin is movably positionable therein.

9. The paper feeding apparatus defined by claim 8, wherein:

said apparatus is arranged and dimensioned such that a sheet of paper inserted into said paper feed slot is engaged and moved from said paper feed slot by said separating roller when said pin of said main shaft engages an end portion of said opening to couple said separating roller to said main shaft, and said paper is moved by said separating roller into contact with said delivery roller, said delivery roller having a peripheral speed faster than a peripheral speed of said separating rollers in accordance with said diameter of said delivery roller being greater than said diameter of said delivery roller, said paper moving at a speed approximately equal to said peripheral speed of said delivery roller and thereby driving said separating roller, via said paper, to rotate faster than said main shaft such that said peripheral speed of said separating roller is approximately equal to said peripheral speed of said delivery roller.

10. The paper feeding apparatus defined by claim 9, wherein:

when said separating roller rotates faster than said main shaft, said separating roller is decoupled from said main shaft.

* * * * *